US007460138B2

(12) United States Patent
Ito

(10) Patent No.: US 7,460,138 B2
(45) Date of Patent: Dec. 2, 2008

(54) PWM SIGNAL GENERATION CIRCUIT AND DISPLAY DRIVER

(75) Inventor: Takuya Ito, Suwa (JP)

(73) Assignee: Seiko Epson Corporation (JP)

( * ) Notice: Subject to any disclaimer, the term of this patent is extended or adjusted under 35 U.S.C. 154(b) by 791 days.

(21) Appl. No.: 11/005,572

(22) Filed: Dec. 6, 2004

(65) Prior Publication Data

US 2005/0140699 A1 Jun. 30, 2005

(30) Foreign Application Priority Data

Dec. 10, 2003 (JP) ..... 2003-412271

(51) Int. Cl.

| | |
|---|---|
| ***G09G 5/10*** | (2006.01) |
| *G09G 3/34* | (2006.01) |
| *G09G 3/36* | (2006.01) |
| *G09G 5/02* | (2006.01) |

(52) U.S. Cl. ..... 345/691; 345/97

(58) Field of Classification Search ..... 345/87–89, 345/94–100, 690–693

See application file for complete search history.

(56) References Cited

U.S. PATENT DOCUMENTS

| | | | | |
|---|---|---|---|---|
| 4,775,891 | A * | 10/1988 | Aoki et al. | 348/572 |
| 5,583,530 | A * | 12/1996 | Mano et al. | 345/89 |
| 6,377,234 | B1 * | 4/2002 | Nogawa | 345/89 |
| 6,597,371 | B2 * | 7/2003 | Mandl | 345/691 |
| 2002/0012008 | A1 * | 1/2002 | Takagi | 345/691 |
| 2003/0090499 | A1 * | 5/2003 | Kobayashi | 345/690 |
| 2005/0134614 | A1 * | 6/2005 | Tomohara | 345/690 |

FOREIGN PATENT DOCUMENTS

| | | |
|---|---|---|
| JP | 2003-150121 | 5/2003 |

* cited by examiner

*Primary Examiner*—Amare Mengistu
*Assistant Examiner*—Elijah M Sheets
(74) *Attorney, Agent, or Firm*—Harness, Dickey & Pierce, P.L.C.

(57) ABSTRACT

A first grayscale clock pulse generation circuit compares a value stored in each timing register with a first count value and outputs a first grayscale pulse to a selector, a calculation circuit calculates the first count value and outputs a second count value, a second grayscale clock pulse generation circuit compares a value stored in each timing register with the second count value and outputs a second grayscale pulse to the selector, a grayscale counter updates a grayscale count value based on the first or second grayscale clock pulse selectively output from the selector in units of one horizontal scan period, and a grayscale coincidence detection circuit changes a voltage level of a PWM signal when the relationship between grayscale data input to the grayscale coincidence detection circuit and the grayscale count value satisfies a predetermined relationship.

20 Claims, 12 Drawing Sheets

PWM SIGNAL GENERATION CIRCUIT AND DISPLAY DRIVER

Japanese Patent Application No. 2003-412271, filed on Dec. 10, 2003, is hereby incorporated by reference in its entirety.

BACKGROUND OF THE INVENTION

The present invention relates to a PWM signal generation circuit and a display driver.

A pulse width modulation (PWM) circuit has been known as a circuit which represents a gray level of a display panel. PWM enables a grayscale display by driving voltage at a pulse width corresponding to a desired grayscale value in frame units.

However, when increasing the number of grayscales by using PWM, a grayscale clock pulse signal (GCP signal), which is a reference for setting the change point of a pulse width modulation signal, must be generated at a higher frequency, whereby power consumption is increased.

In recent years, a high-quality display panel has been increasingly demanded for a small instrument such as a portable telephone. A circuit which drives a display panel provided in a small instrument or the like has problems to be solved involving a reduction of circuit scale, a reduction of power consumption, and flexible adaptability to various panels.

BRIEF SUMMARY OF THE INVENTION

A PWM signal generation circuit according to one aspect of the present invention includes:

a change timing storage circuit which stores a pulse change timing of a grayscale clock pulse for generating a PWM signal, a first grayscale clock pulse generation circuit, a second grayscale clock pulse generation circuit, a selector, a timing counter, a calculation circuit, a grayscale counter, and a grayscale coincidence detection circuit, wherein the change timing storage circuit includes N (N is an integer greater than one) timing registers, wherein each of the N timing registers stores m bits (m is an integer greater than one) of a predetermined change timing value, wherein the timing counter updates and outputs a first count value in one of an increment direction and a decrement direction in synchronization with a clock signal, wherein the first grayscale clock pulse generation circuit generates a grayscale pulse each time it is judged that the change timing value stored in each of the N timing registers coincides with the first count value, and outputs the grayscale pulse, which is sequentially generated, to the selector as a first grayscale clock pulse, wherein the calculation circuit performs calculation processing of the first count value, and outputs a second count value which is updated in another direction differing from the one direction, wherein the second grayscale clock pulse generation circuit generates a grayscale pulse each time it is judged that the change timing value stored in each of the N timing registers coincides with the second count value, and outputs the grayscale pulse, which is sequentially generated, to the selector as a second grayscale clock pulse, wherein the selector alternately outputs the first or second grayscale clock pulse output from the first or second grayscale clock pulse generation circuit to the grayscale counter as the grayscale clock pulse in units of one horizontal scan period, wherein the grayscale counter updates a grayscale count value in one of the increment direction and the decrement direction based on the grayscale clock pulse output from the selector, and wherein the grayscale coincidence detection circuit compares a relationship between grayscale data input to the grayscale coincidence detection circuit and the grayscale count value, and changes a voltage level of the PWM signal when the relationship between the grayscale data and the grayscale count value satisfies a predetermined relationship.

A display driver according to another aspect of the present invention includes:

the PWM signal generation circuit as defined in claim 1, and a data line driver circuit which drives a plurality of data lines, wherein the data line driver circuit receives the PWM signal and controls a grayscale of the data lines based on the PWM signal.

DETAILED DESCRIPTION OF THE EMBODIMENT

Figure 1:
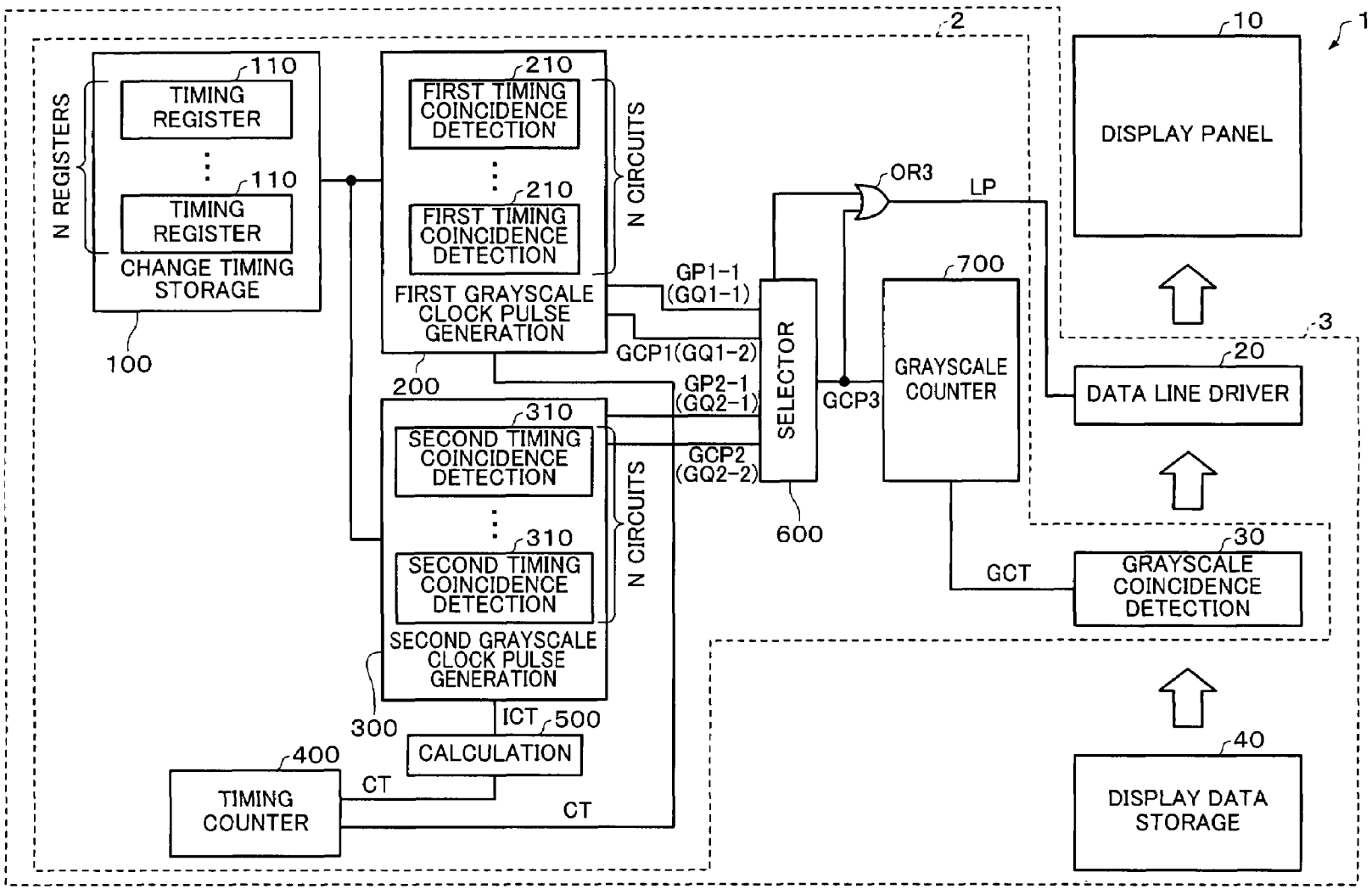
FIG. 1 is a block diagram of an electro-optical device to which a PWM signal generation circuit according to an embodiment of the present invention is applied.

This embodiment has been achieved in view of the above-described technical problems, and can provide a PWM signal generation circuit and a display driver which can flexibly set a grayscale setting suitable for a display panel, has a small circuit scale, and consumes a small amount of electric power.

A PWM signal generation circuit according to one embodiment of the present invention includes:

a change timing storage circuit which stores a pulse change timing of a grayscale clock pulse for generating a PWM signal, a first grayscale clock pulse generation circuit, a second grayscale clock pulse generation circuit, a selector, a timing counter, a calculation circuit, a grayscale counter, and a grayscale coincidence detection circuit, wherein the change timing storage circuit includes N (N is an integer greater than one) timing registers, wherein each of the N timing registers stores m bits (m is an integer greater than one) of a predetermined change timing value, wherein the timing counter updates and outputs a first count value in one of an increment direction and a decrement direction in synchronization with a clock signal, wherein the first grayscale clock pulse generation circuit generates a grayscale pulse each time it is judged that the change timing value stored in each of the N timing registers coincides with the first count value, and outputs the grayscale pulse, which is sequentially generated, to the selector as a first grayscale clock pulse, wherein the calculation circuit performs calculation processing of the first count value, and outputs a second count value which is updated in another direction differing from the one direction, wherein the second grayscale clock pulse generation circuit generates a grayscale pulse each time it is judged that the change timing value stored in each of the N timing registers coincides with the second count value, and outputs the grayscale pulse, which is sequentially generated, to the selector as a second grayscale clock pulse, wherein the selector alternately outputs the first or second grayscale clock pulse output from the first or second grayscale clock pulse generation circuit to the grayscale counter as the grayscale clock pulse in units of one horizontal scan period, wherein the grayscale counter updates a grayscale count value in one of the increment direction and the decrement direction based on the grayscale clock pulse output from the selector, and wherein the grayscale coincidence detection circuit compares a relationship between grayscale data input to the grayscale coincidence detection circuit and the grayscale count value, and changes a voltage level of the PWM signal when the relationship between the grayscale data and the grayscale count value satisfies a predetermined relationship.

This reduces power consumption and circuit scale.

With this PWM signal generation circuit, the change timing storage circuit may include a first subtractor circuit, and the first subtractor circuit may subtract first adjustment data from the change timing value, and may output a result of the subtraction to the timing register.

With this PWM signal generation circuit, a value of the first adjustment data may be "1".

With this PWM signal generation circuit, the calculation circuit may be connected with a resolution storage circuit which stores a resolution value which determines setting accuracy of the change timing of the grayscale clock pulse.

This enables the PWM signal generation circuit to flexibly deal with various display panels.

With this PWM signal generation circuit, the calculation circuit may include an adder circuit and a second subtractor circuit, the adder circuit may add second adjustment data to the first count value output from the timing counter, and may output a result of the addition to the second subtractor circuit, and the second subtractor circuit may subtract an output value from the adder circuit from the resolution value, and may output a result of the subtraction to the second grayscale clock pulse generation circuit as the second count value.

This enables the second grayscale clock pulse generation circuit to output the second grayscale clock pulse.

With this PWM signal generation circuit, a value of the second adjustment data may be "1".

With this PWM signal generation circuit, the resolution value may be $2^m$.

With this PWM signal generation circuit, the first grayscale clock pulse generation circuit may include N first timing coincidence detection circuits, the second grayscale clock pulse generation circuit may include N second timing coincidence detection circuits, and the N timing registers of the change timing storage circuit may be connected with the N first timing coincidence detection circuits and the N second timing coincidence detection circuits.

This reduces the circuit scale.

With this PWM signal generation circuit, the first grayscale clock pulse generation circuit may include a first OR circuit, and the first OR circuit may calculate logical OR of an output from at least (N−1) first timing coincidence detection circuit among the N first timing coincidence detection circuits, and may output a result of the calculation to the selector.

With this PWM signal generation circuit, the selector may output an output from at least one first timing coincidence detection circuit among the N first timing coincidence detection circuits to a data line driver circuit which is an output destination of the grayscale coincidence detection circuit, without outputting the output from the at least one first timing coincidence detection circuit to the grayscale counter.

With this PWM signal generation circuit, a value "0" may be stored in the timing register connected with the at least one first timing coincidence detection circuit.

According to this feature, when the first grayscale clock pulse is selectively output to the grayscale counter by the selector, the change timing of the voltage level of the PWM signal when the grayscale data is "0" can be arbitrarily set.

With this PWM signal generation circuit, the second grayscale clock pulse generation circuit may include a second OR circuit, and the second OR circuit may calculate logical OR of an output from at least (N−1) second timing coincidence detection circuit among the N second timing coincidence detection circuits, and may output a result of the calculation to the selector.

With this PWM signal generation circuit, the selector may output an output from at least one second timing coincidence detection circuit among the N second timing coincidence detection circuits to a data line driver circuit which is an output destination of the grayscale coincidence detection circuit, without outputting the output from the at least one second timing coincidence detection circuit to the grayscale counter.

With this PWM signal generation circuit, the change timing value closest to $2^m$ may be stored in the timing register connected with the at least one second timing coincidence detection circuit.

According to this feature, when the second grayscale clock pulse is selectively output to the grayscale counter by the selector, the change timing of the voltage level of the PWM signal when the grayscale data is "N" can be arbitrarily set.

With this PWM signal generation circuit, the grayscale coincidence detection circuit may receive the grayscale count value as an n-bit first digital signal, may receive the grayscale data as an n-bit second digital signal, may compare the n-bit first digital signal with the n-bit second digital signal, and may detect a state in which the first digital signal and the second digital signal have had a predetermined relationship, the grayscale coincidence detection circuit may include:

serially connected first to n-th transistors of first conductivity type, each bit of the first digital signal being input to a gate electrode of each of the first to n-th transistors;

serially connected (n+1)th to 2n-th transistors of first conductivity type, each bit of the second digital signal being input to a gate electrode of each of the (n+1)th to 2n-th transistors, and a source terminal and a drain terminal of each of the (n+1)th to 2n-th transistors being connected with a source terminal and a drain terminal of each of the first to n-th transistors;

a first precharge circuit which is connected with a first node to which the drain terminal of each of the first and (n+1)th transistors is connected and which precharges the first node to a first power supply potential side when a precharge signal has become active;

a connection circuit which is connected with a second node to which the drain terminal of each of the n-th and 2n-th transistors is connected and which connects the second node with a second power supply potential when the precharge signal has become inactive;

a holding circuit which holds a potential of the first node; and a second precharge circuit which is connected with an intermediate node to which the source terminals of the K-th and (K+n)th (K is a natural number provided that $1<K<n$) transistors are connected and which precharges the intermediate node to the first power supply potential side when the precharge signal has become active, and the second precharge circuit may be connected with the intermediate node which allows K to satisfy a relationship $2 \leqq K \leqq n-2$.

This enables coincidence between the grayscale data and the grayscale count value to be detected.

A display driver according to another embodiment of the present invention includes:

the PWM signal generation circuit as defined in claim 1, and a data line driver circuit which drives a plurality of data lines, wherein the data line driver circuit receives the PWM signal and controls a grayscale of the data lines based on the PWM signal.

This display driver may include a display data storage circuit which stores display data for at least one frame, and the grayscale coincidence detection circuit may compare a relationship between the grayscale data included in the display data stored in the display data storage circuit and the grayscale count value, and may output the PWM signal to the data line driver circuit when the relationship between the grayscale data and the grayscale count value satisfies a predetermined relationship.

This enables the data line driver circuit to drive the data line at a grayscale according to the display data.

This display driver may includes a third OR circuit which outputs a latch pulse to the data line driver circuit, and the selector may alternately select the first and second grayscale clock pulse generation circuits in units of one horizontal scan period, when the first grayscale clock pulse generation circuit is selected, the selector may output an output from at least one of the first timing coincidence detection circuits to the third OR circuit, without outputting the output from the at least one first timing coincidence detection circuit to the grayscale counter, and may output an output from the other of the first timing coincidence detection circuits to the grayscale counter and the third OR circuit, and when the second grayscale clock pulse generation circuit is selected, the selector may output an output from at least one of the second timing coincidence detection circuits to the third OR circuit, without outputting the output from the at least one second timing coincidence detection circuit to the grayscale counter, and may output an output from the other of the second timing coincidence detection circuits to the grayscale counter and the third OR circuit, and the third OR circuit may calculate logical OR of a value input by the selector and may output a result of the calculation to the data line driver circuit as the latch pulse.

This enables the change timing of the voltage level of the PWM signal when the grayscale data is "0" to be arbitrarily set.

Embodiments of the present invention are described below with reference to the drawings. Note that the embodiments described hereunder do not in any way limit the scope of the invention defined by the claims laid out herein. Note also that not all of the elements of these embodiments should be taken as essential requirements to the means of the present invention.

1. Electro-optical Device and PWM Signal Generation Circuit

FIG. 1 is a block diagram of an electro-optical device 1 to which a pulse width modulation (PWM) signal generation circuit 2 according to an embodiment of the present invention is applied. The electro-optical device 1 includes a display panel 10, a data line driver circuit 20, a grayscale coincidence detection circuit 30, a display data storage circuit 40, a change timing storage circuit 100, a first grayscale clock pulse generation circuit 200, a second grayscale clock pulse generation circuit 300, a timing counter 400, a calculation circuit 500, a selector 600, a grayscale counter 700, and an OR circuit 3 (third OR circuit). A display driver 3 includes the PWM signal generation circuit 2, the data line driver circuit 20, and the display data storage circuit 40. However, the display driver 3 may have a configuration in which the display driver 3 does not include the display data storage circuit 40.

The change timing storage circuit 100 includes N timing registers 110. Each timing register 110 can store m bits of information. The first grayscale clock pulse generation circuit 200 includes N first timing coincidence detection circuits 210. The second grayscale clock pulse generation circuit 300 includes N second timing coincidence detection circuits 310. The N first timing coincidence detection circuits 210 and the N second timing coincidence detection circuits 310 are connected with N timing registers 110. In other drawings, sections denoted by the same symbols have the same meaning.

Each first timing coincidence detection circuit 210 in the first grayscale clock pulse generation circuit 200 receives a count value CT (first count value in a broad sense) output from the timing counter 400, and compares the count value CT with the value (change timing value) stored in the timing register 110. When the count value CT coincides with the value (change timing value) stored in the timing register 110, the first grayscale clock pulse generation circuit 200 generates a grayscale pulse. The timing counter 400 sequentially updates the count value CT, and outputs the updated count value CT to the first grayscale clock pulse generation circuit 200 and the calculation circuit 500.

Specifically, the first grayscale clock pulse generation circuit 200 generates the grayscale pulse each time the first timing coincidence detection circuit 210 detects that the count value CT, which is sequentially updated, coincides with the value (change timing value) stored in each of the N timing registers 110. As a first grayscale clock pulse GCP1, (N−1) grayscale pulses generated by the first grayscale clock pulse generation circuit 200 are output to the selector 600 through an output line GQ1-2. The remaining grayscale pulse GP1-1 is output to the selector 600 through another system (through output line GQ1-1) without being included in the first grayscale clock pulse GCP1.

The calculation circuit 500 receives the count value CT from the timing counter 400, performs calculation processing of the count value CT, and outputs the calculation result to the second grayscale clock pulse generation circuit 300 as an inverted count value ICT (second count value in a broad sense). The inverted count value ICT is sequentially updated by the calculation circuit 500 corresponding to the count value CT which is sequentially updated, and is output to the second grayscale clock pulse generation circuit 300.

Each second timing coincidence detection circuit 310 in the second grayscale clock pulse generation circuit 300 receives the inverted count value ICT output from the calculation circuit 500, and compares the inverted count value ICT with the value (change timing value) stored in the timing register 110. When the inverted count value ICT coincides with the value stored in the timing register 110, the second grayscale clock pulse generation circuit 300 generates the grayscale pulse.

Specifically, the second grayscale clock pulse generation circuit 300 generates the grayscale pulse each time the second timing coincidence detection circuit 310 detects that the inverted count value ICT, which is sequentially updated, coincides with the value (change timing value) stored in each of the N timing registers 110. As a second grayscale clock pulse GCP2, (N−1) grayscale pulses among the N grayscale pulses generated by the second grayscale clock pulse generation circuit 300 are output to the selector 600 through an output line GQ2-2 . The remaining grayscale pulse GP2-1 is output to the selector 600 through another system (through output line GQ2-1) without being included in the second grayscale clock pulse GCP2.

The selector 600 alternately selects the output from the first grayscale clock pulse generation circuit 200 and the output from the second grayscale clock pulse generation circuit 300 in units of one horizontal scan period, for example, and outputs the first or second grayscale clock pulse GCP1 or GCP2 output from the selected grayscale clock pulse generation circuit to the grayscale counter 700 and the OR circuit OR3 as a grayscale clock pulse GCP3. The selector 600 outputs the grayscale pulse GP1-1 or the grayscale pulse GP2-1 output from the selected grayscale clock pulse generation circuit to the OR circuit OR3. The OR circuit OR3 calculates the logical OR of the input pulses and outputs the calculation result to the data line driver circuit 20 as a latch pulse LP.

The grayscale counter 700 updates a grayscale count value GCT in the increment direction (or the decrement direction) each time the voltage of the input grayscale clock pulse GCP3 changes, and sequentially outputs the updated grayscale count value GCT to the grayscale coincidence detection circuit 30.

The grayscale coincidence detection circuit 30 compares the grayscale data included in the display data stored in the display data storage circuit with the grayscale count value GCT output from the grayscale counter 700. When the compared values satisfy a predetermined relationship, the grayscale coincidence detection circuit 30 changes the voltage level of the PWM signal output to the data line driver circuit 20. The predetermined relationship is described later.

The data line driver circuit 20 receives the PWM signal from the grayscale coincidence detection circuit 30, and drives the display panel 10 according to the latch pulse LP from the OR circuit OR3.

In order to describe this embodiment, the PWM signal generation circuit corresponding to 16 grayscales (N=16) is described below as an example.

2. PWM Signal Generation Circuit

Figure 2:
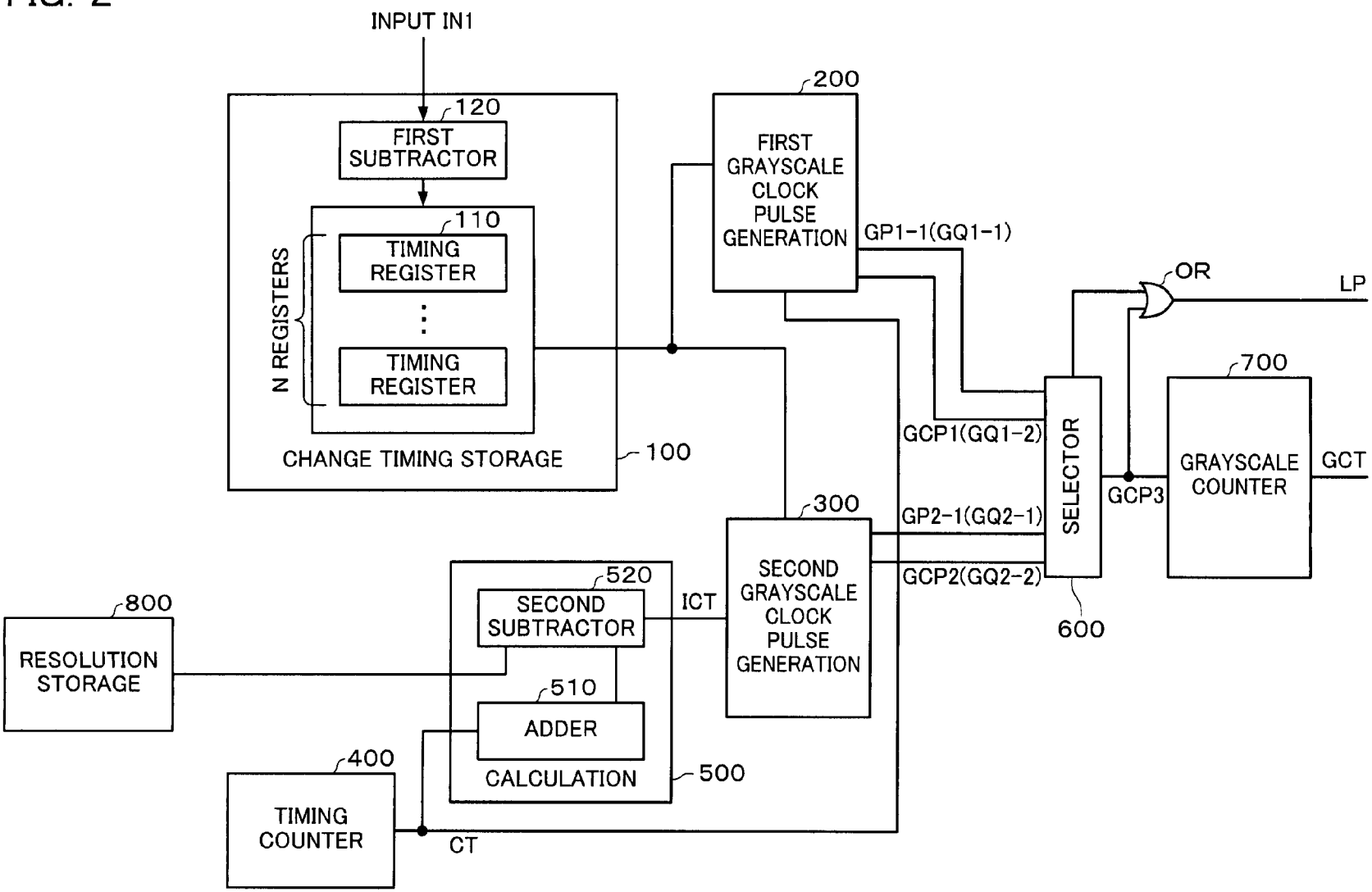
FIG. 2 is a block diagram showing a part of a PWM signal generation circuit according to this embodiment.

FIG. 2 is a block diagram showing a part of the PWM signal generation circuit according to this embodiment. The circuits shown in FIG. 2 further include a resolution storage circuit 800 which outputs a resolution value to the calculation circuit 500. The number of divisions when dividing one horizontal scan period by a predetermined unit time corresponds to the resolution value. The voltage change timing of the grayscale clock pulse also depends on the resolution value. In other words, the resolution value is set at a higher value when setting the change timing of the PWM signal with higher accuracy.

The change timing storage circuit 100 includes the 16 (N in a broad sense) timing registers 110, and further includes a first subtractor circuit 120. At the time of initialization, 8-bit (m-bit in a broad sense) data for determining the change timing of a grayscale clock pulse GCP3 (change timing of the PWM signal) is input to an input IN1 of the change timing storage circuit 100.

The first subtractor circuit 120 performs subtraction processing for the m-bit data input to the change timing storage circuit 100, and outputs the subtraction result to the timing register 110. In more detail, the first subtractor circuit 120 subtracts "1" (first adjustment data in a broad sense) from the value of the input data, and outputs the subtraction result to the timing register 110. Since the 8-bit data corresponding to each of the 16 timing registers 110 is sequentially input to the change timing storage circuit 100, the sequentially input m-bit data is subjected to the subtraction processing and is output to each timing register 110.

Each of the 16 timing registers 110 is connected with the first grayscale clock pulse generation circuit 200 and the second grayscale clock pulse generation circuit 300.

The first grayscale clock pulse generation circuit 200 compares the value of the 8-bit data stored in each timing register 110 with the count value CT which is sequentially updated, and generates the grayscale pulse each time these values coincide.

The calculation circuit 500 includes an adder circuit 510 and a second subtractor circuit 520. The adder circuit 510 receives the count value CT from the timing counter 400, performs addition processing for the count value CT, and outputs the resulting value to the second subtractor circuit 520. In more detail, the adder circuit 510 adds "1" (second adjustment data in a broad sense) to the input count value CT, and outputs the addition result to the second subtractor circuit 520.

The second subtractor circuit subtracts the output value from the adder circuit 510 from the resolution value which is the output value from the resolution storage circuit 800, and outputs the subtraction result to the second grayscale clock pulse generation circuit 300 as the inverted count value ICT. In the case of expressing 16 grayscales, the resolution value when dividing one horizontal scan period into 256 is 255, for example. In this case, if the count value CT is "1", the inverted count value ICT is 255−(1+1)=253. The inverted count value ICT is sequentially updated by the calculation circuit 500 each time the count value CT is updated.

The second grayscale clock pulse generation circuit 300 compares the value of the 8-bit data stored in each timing register 110 with the inverted count value ICT which is sequentially updated, and generates the grayscale pulse each time these values coincide.

Figure 3:
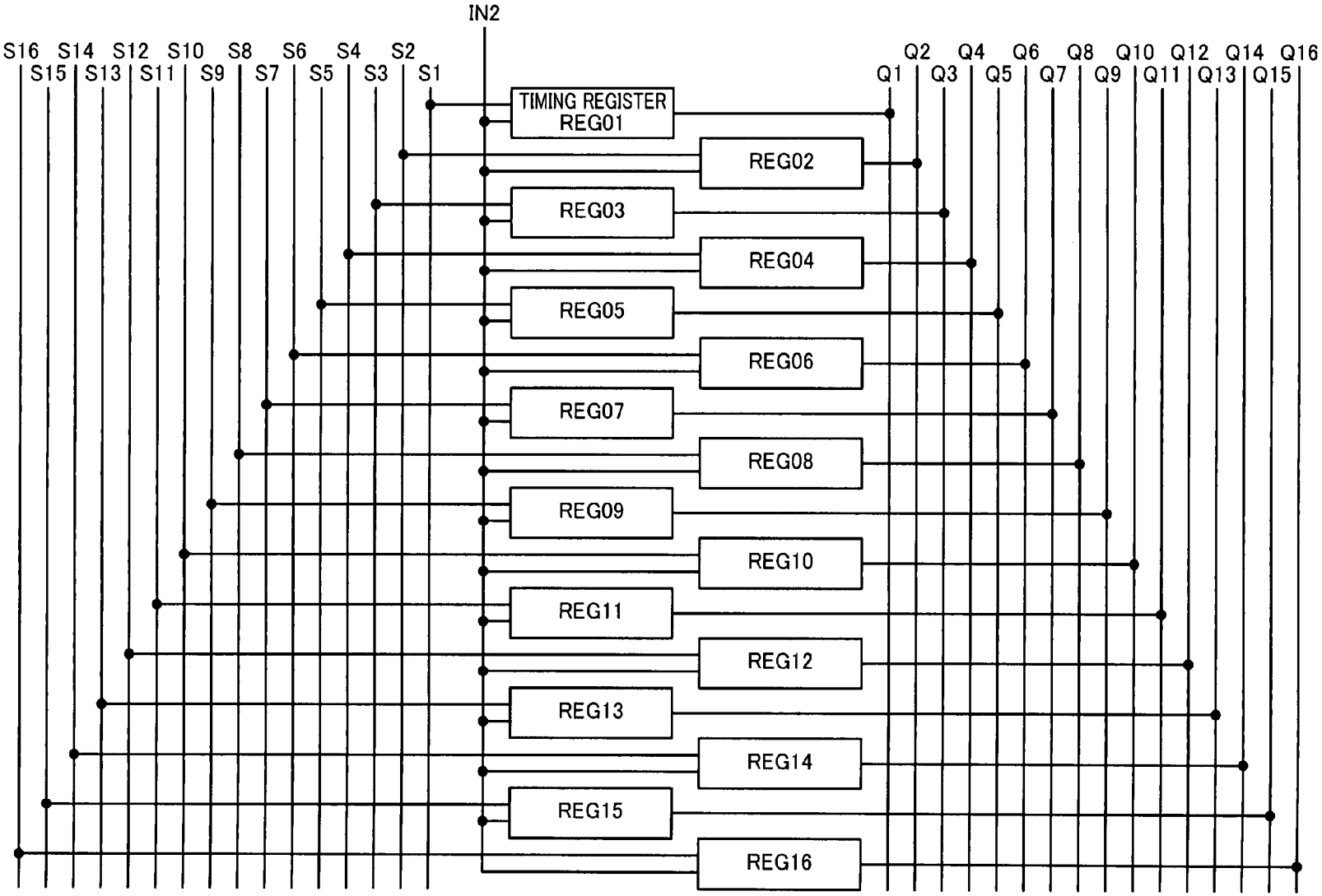
FIG. 3 shows timing registers in a change timing storage circuit according to this embodiment.

FIG. 3 is diagram showing the 16 timing registers 110 in the change timing storage circuit 100 according to this embodiment. Symbols REG01 to REG16 respectively denote the timing registers 110. Through an input IN2, 8-bit data is input to each of the timing registers REG01 to REG16. Select lines S1 to S16 are respectively connected with the timing registers REG01 to REG16. For example, the select line S1 is activated when writing data into the timing register REG01, whereby 8-bit data is written into the timing register REG01.

At the time of initialization, 8-bit data is written into each of the timing registers REG01 to REG16. Specifically, information which determines the change timing of the grayscale clock pulse GCP3 (change timing of the PWM signal) is written into each of the timing registers REG01 to REG16. The outputs from the timing registers REG01 to REG16 are respectively output to output lines Q1 to Q16.

Figure 4:
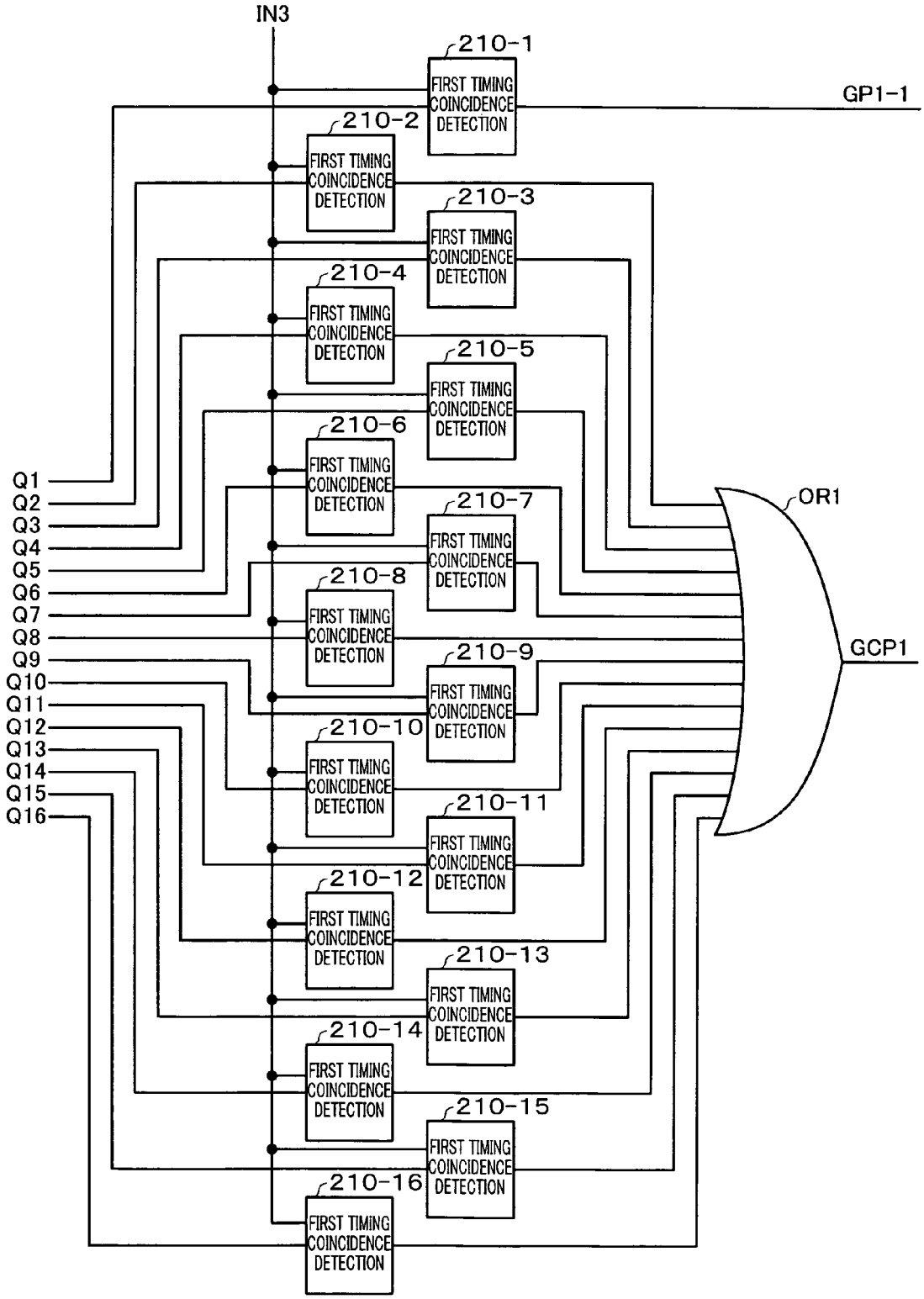
FIG. 4 is a block diagram of a first grayscale clock pulse generation circuit according to this embodiment.

FIG. 4 is a block diagram of the first grayscale clock pulse generation circuit 200 according to this embodiment. The output lines Q1 to Q16 to which the data stored in each timing register 110 is output are connected with first timing coincidence detection circuits 210-1 to 210-16. For example, the output line Q1 is connected with the first timing coincidence detection circuit 210-1. The count value CT from the timing counter 400 is input to the first timing coincidence detection circuits 210-1 to 210-16 through an input IN3. Each of the first timing coincidence detection circuits 210-1 to 210-16 compares the output value from each of the output lines Q1 to Q16 with the count value CT, and outputs a pulse as the grayscale pulse when these values coincide. Specifically, the grayscale pulse is output each time the count value CT, which is sequentially updated, coincides with the 8-bit data stored in one of the timing registers 110.

The grayscale pulses output from the first timing coincidence detection circuits 210-2 to 210-16 among the first timing coincidence detection circuits 210-1 to 210-16 are output to an OR circuit OR1 (first OR circuit in a broad sense). The grayscale pulse GP1-1 output from the first timing coincidence detection circuit 210-1 is output to the selector 600 through another system (through the output line GQ1-1).

The OR circuit OR1 outputs the input grayscale pulse to the selector 600 through the output line GQ1-2 as the first grayscale clock pulse GCP1.

Figure 5:
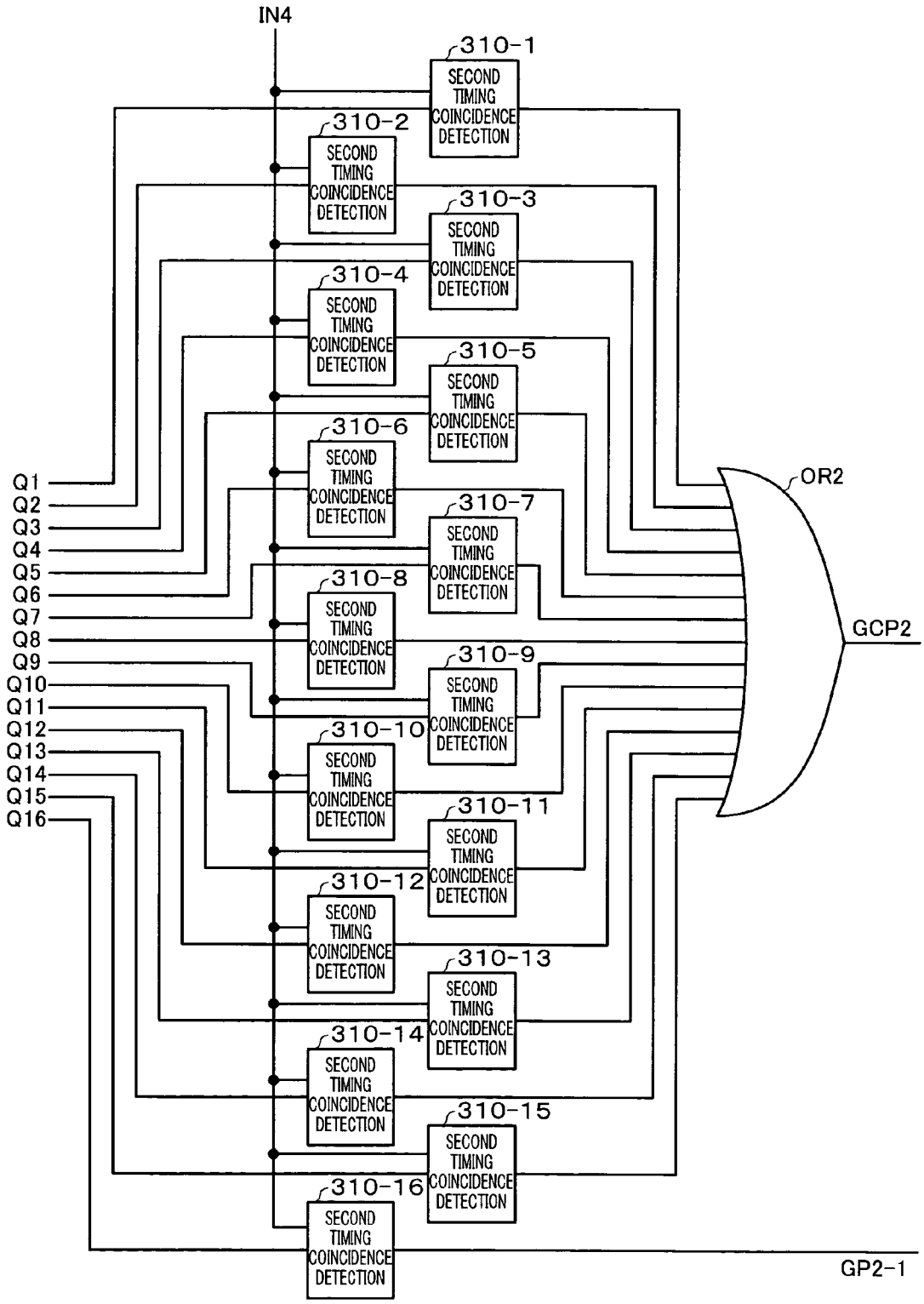
FIG. 5 is a block diagram of a second grayscale clock pulse generation circuit according to this embodiment.

FIG. 5 is a block diagram of the second grayscale clock pulse generation circuit 300 according to this embodiment. The output lines Q1 to Q16 to which the data stored in each timing register 110 is output are connected with the second timing coincidence detection circuits 310-1 to 310-16. For example, the output line Q1 is connected with the second timing coincidence detection circuit 310-1. The inverted count value ICT from the calculation circuit 500 is input to the second timing coincidence detection circuits 310-1 to 310-16 through an input IN4. Each of the second timing coincidence detection circuits 310-1 to 310-16 compares the output value from each of the output lines Q1 to Q16 with the inverted count value ICT, and outputs a pulse as the grayscale pulse when these values coincide. Specifically, the grayscale pulse is output each time the inverted count value ICT, which is sequentially updated, coincides with the 8-bit data stored in one of the timing registers 110.

The grayscale pulses output from the second timing coincidence detection circuits 310-1 to 310-15 among the second timing coincidence detection circuits 310-1 to 310-16 are output to an OR circuit OR2 (second OR circuit in a broad sense). The grayscale pulse GP2-1 output from the second timing coincidence detection circuit 310-1 is output to the selector 600 through another system (through the output line GQ2-1).

The OR circuit OR2 outputs the input grayscale pulse to the selector 600 through the output line GQ2-2 as the second grayscale clock pulse GCP2.

The selector 600 alternately selects the output from the first grayscale clock pulse generation circuit 200 and the output from the second grayscale clock pulse generation circuit 300 in units of one horizontal scan period. For example, when the output from the first grayscale clock pulse generation circuit 200 is selected, the selector 600 outputs the first grayscale clock pulse GCP1 from the OR circuit OR1 shown in FIG. 4 to the grayscale counter 700 shown in FIG. 2 and the OR circuit OR3 shown in FIG. 2. When the output from the first grayscale clock pulse generation circuit 200 is selected, the selector 600 outputs the output pulse (grayscale pulse GP1-1) from the first timing coincidence detection circuit 210-1 shown in FIG. 4 to the OR circuit OR3 shown in FIG. 2.

When the second grayscale clock pulse generation circuit 300 is selected, the selector 600 outputs the second grayscale clock pulse GCP2 from the OR circuit OR2 shown in FIG. 5 to the grayscale counter 700 and the OR circuit OR3, and outputs the output pulse (grayscale pulse GP2-1) from the second timing coincidence detection circuit 310-16 shown in FIG. 5 to the OR circuit OR3.

In other words, the grayscale counter 700 counts the rising edge of the first or second grayscale clock pulse GCP1 or GCP2. In this embodiment, the counter is updated at the rising timing of the pulse. However, the counter may be updated at the falling timing of the pulse.

The relationship among the count value CT, the inverted count value ICT, the grayscale clock pulses GCP1 and GCP2, and the grayscale count value GCT according to this embodiment is described below.

Figure 6:
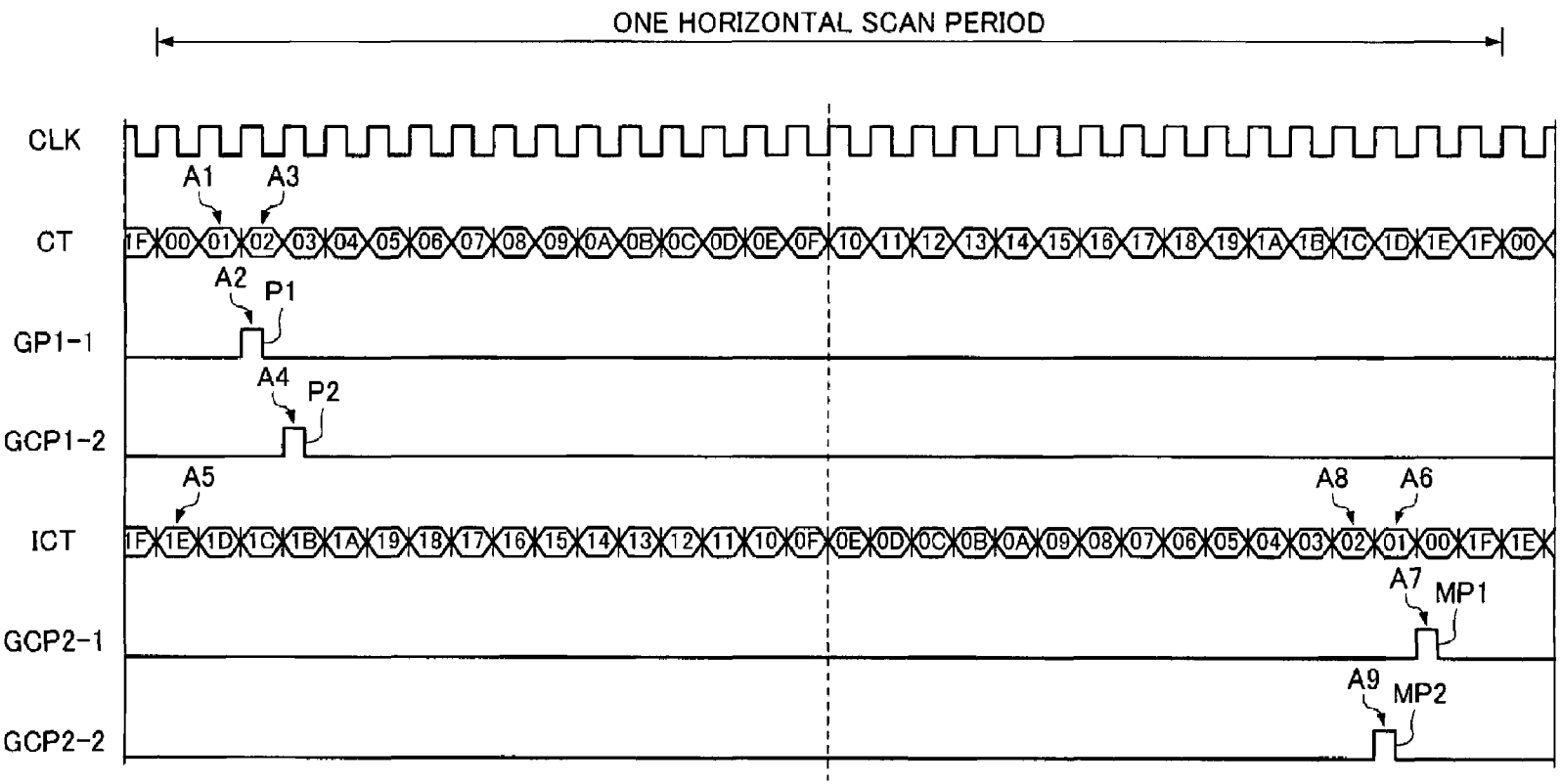
FIG. 6 is a timing waveform diagram showing the relationship among a count value, an inverted count value, and a grayscale clock pulse according to this embodiment.

FIG. 6 is a timing waveform diagram showing the relationship among the count value CT, the inverted count value ICT, and the grayscale clock pulses (GCP1-1, GCP1-2, GCP2-1, and GCP2-2) according to this embodiment. The grayscale clock pulse GCP1-1 is the grayscale clock pulse GCP1 output from the first timing coincidence detection circuit 210-2, and the grayscale clock pulse GCP1-2 is the grayscale clock pulse GCP1 output from the first timing coincidence detection circuit 210-3. The grayscale clock pulse GCP2-1 is the grayscale clock pulse GCP2 output from the second timing coincidence detection circuit 310-2, and the grayscale clock pulse GCP2-2 is the grayscale clock pulse GCP2 output from the second timing coincidence detection circuit 310-3. In FIG. 6, the count value CT is set so that the count value CT changes in 32 stages consisting of "0" to "1F" within one horizontal scan period. However, this embodiment is not limited thereto. In this embodiment, the resolution storage circuit 800 stores "1F" (hexadecimal number) as the resolution value in order to express 32 stages consisting of "0" to "31". A clock signal CLK is a synchronization signal for outputting the count value CT. The count value CT is sequentially updated in synchronization with the clock signal CLK.

For example, "1" has been written into the timing register REG02 shown in FIG. 3 connected with the first timing coincidence detection circuit 210-2. As indicated by A1 in FIG. 6, the first timing coincidence detection circuit 210-2 judges that the count value CT coincides with the value of the timing register REG02 when the count value CT becomes "1", and outputs the grayscale pulse P1 indicated by A2.

Since "2" has been written into the timing register REG03 shown in FIG. 3, for example, the grayscale pulse P2 indicated by A4 is output when the count value CT becomes "2" as indicated by A3.

In FIG. 6, when the count value CT is "0", the inverted count value ICT is "1E" ("30" in decimal numbers) as indicated by A5. Specifically, the calculation circuit 500 performs calculation processing of the count value CT "0", whereby the value "1E" is output to the second grayscale clock pulse generation circuit 300 as the inverted count value ICT. The count value CT "0" is output from the timing counter 400 shown in FIG. 2 to the adder circuit 510 of the calculation circuit 500. The adder circuit 510 adds "1" to the count value CT "0", and outputs the addition result (0+1) to the second subtractor circuit 520. The second subtractor circuit 520 receives the resolution value ("1F", for example) from the resolution storage circuit 800, subtracts the output value ("1") from the adder circuit 510 from the resolution value ("1F", for example), and outputs the subtraction result (1F−1=E) to the second grayscale clock pulse generation circuit 300 as the inverted count value ICT.

Specifically, the inverted count value ICT when the count value CT is "0" is "1E". When the count value CT is "1", the inverted count value ICT becomes (1F−2=1D). Specifically, when the count value CT is updated in the increment direction, the inverted count value ICT is updated in the decrement direction opposite to the direction in which the count value CT is updated. In this embodiment, the count value CT is updated in the increment direction. However, the count value CT may be updated in the decrement direction.

Since "1" has been stored in the timing register REG02, for example, the second timing coincidence detection circuit 310-2 outputs a pulse MP1 indicated by A7 when the updated inverted count value ICT is "1" as indicated by A6. Since "2" has been stored in the timing register REG03, for example, the second timing coincidence detection circuit 310-3 outputs a pulse MP2 indicated by A9 when the updated inverted count value ICT is "2" as indicated by A8.

Figure 7:
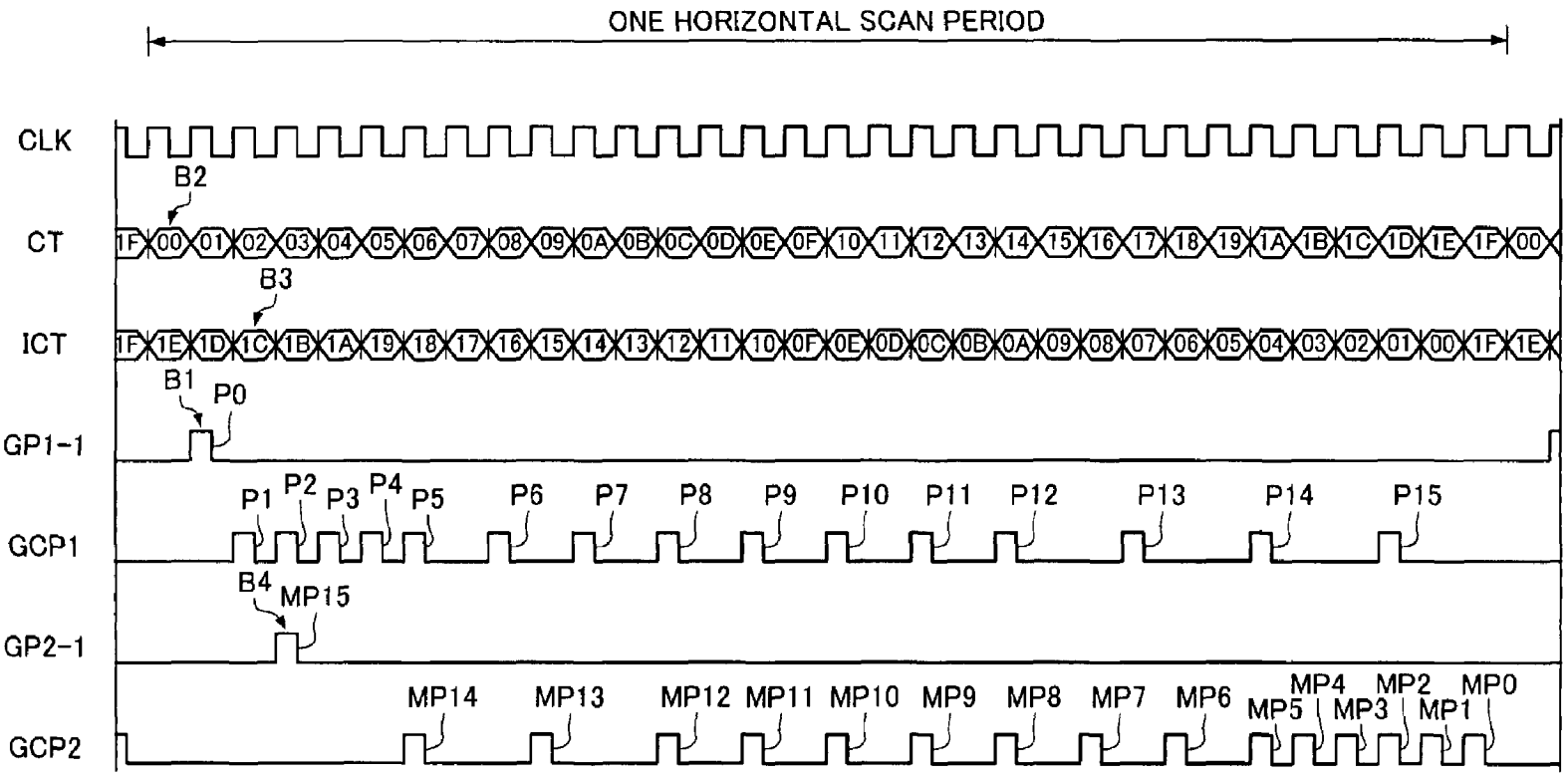
FIG. 7 shows a grayscale clock pulse in one horizontal scan period according to this embodiment.

FIG. 7 is a diagram showing the grayscale clock pulse in one horizontal scan period according to this embodiment. The grayscale pulse P0 indicated by B1 is a pulse output from the first timing coincidence detection circuit 210-1 shown in FIG. 4. In the case where "0" has been written into the timing register REG01 shown in FIG. 3, for example, the first timing coincidence detection circuit 210-1 judges that the value of the timing register REG01 coincides with the count value CT when the count value CT becomes "0" as indicated by B2, and outputs the grayscale pulse P0 indicated by B1. The grayscale pulse P0 is output to the selector 600 through a system differing from that of the first grayscale clock pulse GCP1 (through the output line GQ1-1) as the grayscale pulse GCP1-1. The grayscale pulses P1 to P15 are output to the selector 600 as the first grayscale clock pulse GCP1.

A pulse MP15 indicated by B4 is a pulse output from the second timing coincidence detection circuit 310-16 shown in FIG. 5. In the case where "1C" has been written into the timing register REG16 shown in FIG. 3, for example, the second timing coincidence detection circuit 310-16 judges that the value of the timing register REG16 coincides with the count value CT when the count value CT becomes "1C" as indicated by B3, and outputs the pulse MP15 indicated by B4. The pulse MP15 is output to the selector 600 through a system differing from that of the second grayscale clock pulse GCP2 (through the output line GQ2-1) as the grayscale pulse GCP2-1. The pulses MP1 to MP14 are output to the selector 600 as the second grayscale clock pulse GCP2.

Figure 8:
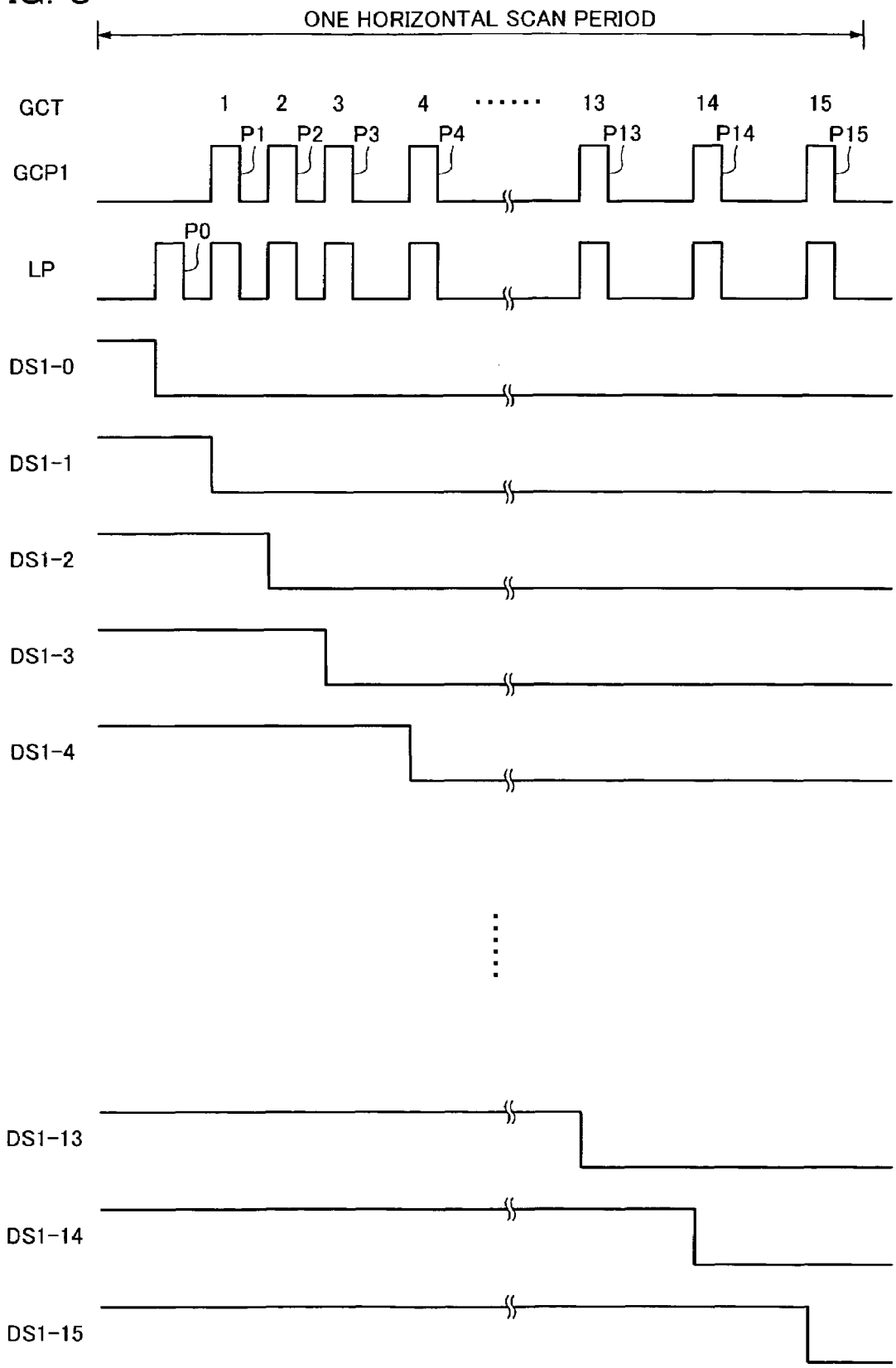
FIG. 8 is a waveform diagram showing the relationship between a latch pulse and a grayscale in a first grayscale clock pulse generation circuit according to this embodiment.

FIG. 8 is a waveform diagram showing the relationship between the latch pulse LP and the grayscale in the first grayscale clock pulse generation circuit according to this embodiment. A data line drive signal DS1-0 is a data line drive signal corresponding to a grayscale value "0". Data line drive signals DS1-1 to DS1-15 are data line drive signals respectively corresponding to a grayscale value "1" to a grayscale value "15". A grayscale representation is performed at a change timing of the voltage level of the data line drive signal. When the voltage level of the PWM signal output from the grayscale coincidence detection circuit 30 shown in FIG. 1 is changed, the voltage level of the data line drive signal changes in synchronization with the rising edge of the latch pulse LP.

When the grayscale pulse P1 is output to the grayscale counter 700, the grayscale counter 700 updates the grayscale count value GCT from "0" to "1". The grayscale count value GCT, which is sequentially updated, is updated to "15" corresponding to the grayscale pulse P15. Since it is necessary to provide 16 change points of the voltage level of the PWM signal in order to express 16 grayscales, the grayscale pulse P0 is output as the latch pulse LP together with the grayscale pulses P1 to P15. The change timing of the voltage level of the PWM signal corresponding to the grayscale value "0" can be arbitrarily set by allowing the grayscale pulse P0 to be included in the latch pulse LP.

Figure 9:
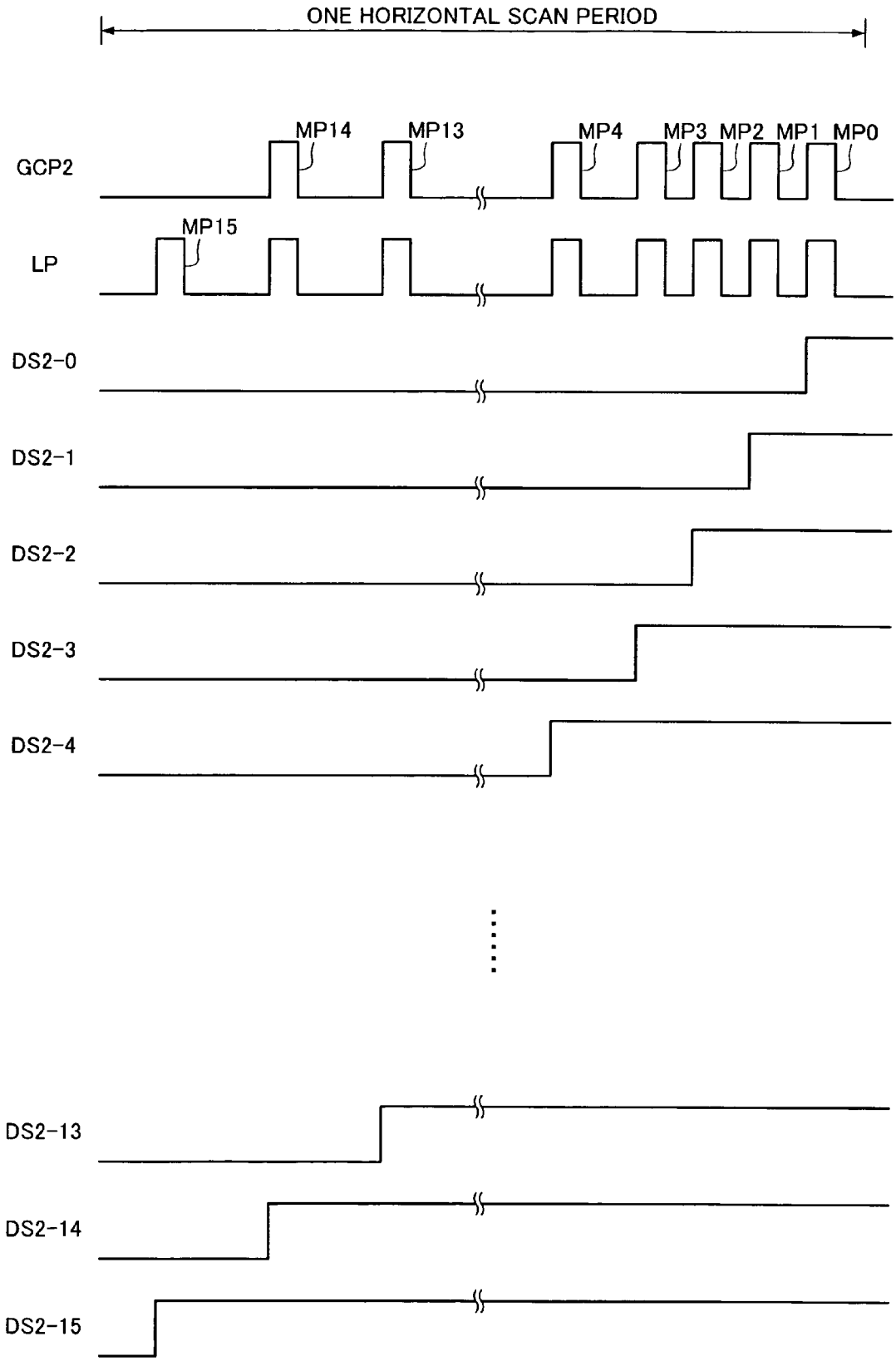
FIG. 9 is a waveform diagram showing the relationship between a latch pulse and a grayscale in a second grayscale clock pulse generation circuit according to this embodiment.

FIG. 9 is a waveform diagram showing the relationship between the latch pulse LP and the grayscale in the second grayscale clock pulse generation circuit 300 according to this embodiment. Data line drive signals DS2-0 to DS2-15 are data line drive signals respectively corresponding to the grayscale value "0" to the grayscale value "15" in the same manner as described above. The pulses MP0 to MP15 are output as the latch pulse LP for the same reason as described for FIG. 8. The change timing of the voltage level of the PWM signal corresponding to the grayscale value "15" can be arbitrarily set by allowing the pulse MP15 to be included in the latch pulse LP.

When the grayscale value "13" has been stored in the display data storage circuit 40 as the grayscale data, for example, the grayscale coincidence detection circuit 30 compares the grayscale count value GCT, which is output from the grayscale counter 700 while being sequentially updated, with the value of the grayscale data (grayscale value "13"). When the grayscale count value GCT has become "13", the grayscale coincidence detection circuit 30 changes the voltage level of the PWM signal. The data line driver circuit 20 receives the change in the voltage level of the PWM signal, and changes the voltage level of the data line drive signal in the same manner as the data line drive signal DS1-13 or DS2-13 in synchronization with the latch pulse LP.

When comparing the rising timings of the grayscale pulse P0 shown in FIG. 7 and the pulse MP0 shown in FIG. 7, the rising timings have a line-symmetrical relationship with respect to the middle of one horizontal scan period as the axis. The same description applies to the grayscale pulse P1 and the grayscale pulse MP1. The data line drive signal DS1-0 shown in FIG. 8 and the data line drive signal DS2-0 shown in FIG. 9 correspond to the grayscale value "0". Specifically, since the rising timings have a line-symmetrical relationship with respect to the middle of the horizontal scan period as the axis, a period in which the voltage level of the data line drive signal is at the high level is the same between the data line drive signals DS1-0 and DS2-0. The grayscale values corresponding to the data line drive signals DS1-1 to DS1-15 are the same as the grayscale values corresponding to the data line drive signals DS2-1 to DS2-15, respectively. The reason why two types of data line drive signals whose voltage change timings are symmetrical are used for a single grayscale value is described below.

Figure 10:
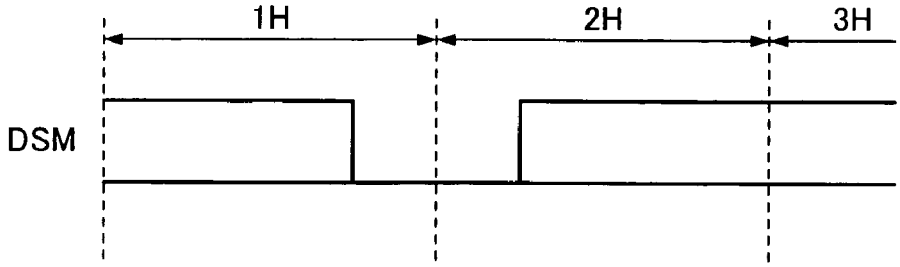
FIG. 10 is a waveform diagram showing a change in a data line drive signal according to this embodiment in units of one horizontal scan period.

FIG. 10 is a waveform diagram showing a change in the data line drive signal according to this embodiment in units of one horizontal scan period. In a horizontal scan period 1H , the voltage level of a data line drive signal DSM changes from the high level to the low level. Since the selector 600 shown in FIG. 1 alternately and selectively outputs the first grayscale clock pulse GCP1 and the second grayscale clock pulse GCP2, the voltage level of the data line drive signal DSM changes from the low level to the high level in a horizontal scan period 2H, and the voltage level of the data line drive signal DSM changes from the high level to the low level in a horizontal scan period 3H. Since the voltage level of the data line drive signal DSM does not change at the boundary between the horizontal scan period 2H and the horizontal scan period 3H, the number of changes of the voltage level can be reduced. Specifically, power consumption can be reduced.

3. Grayscale Coincidence Detection Circuit

Figure 11:
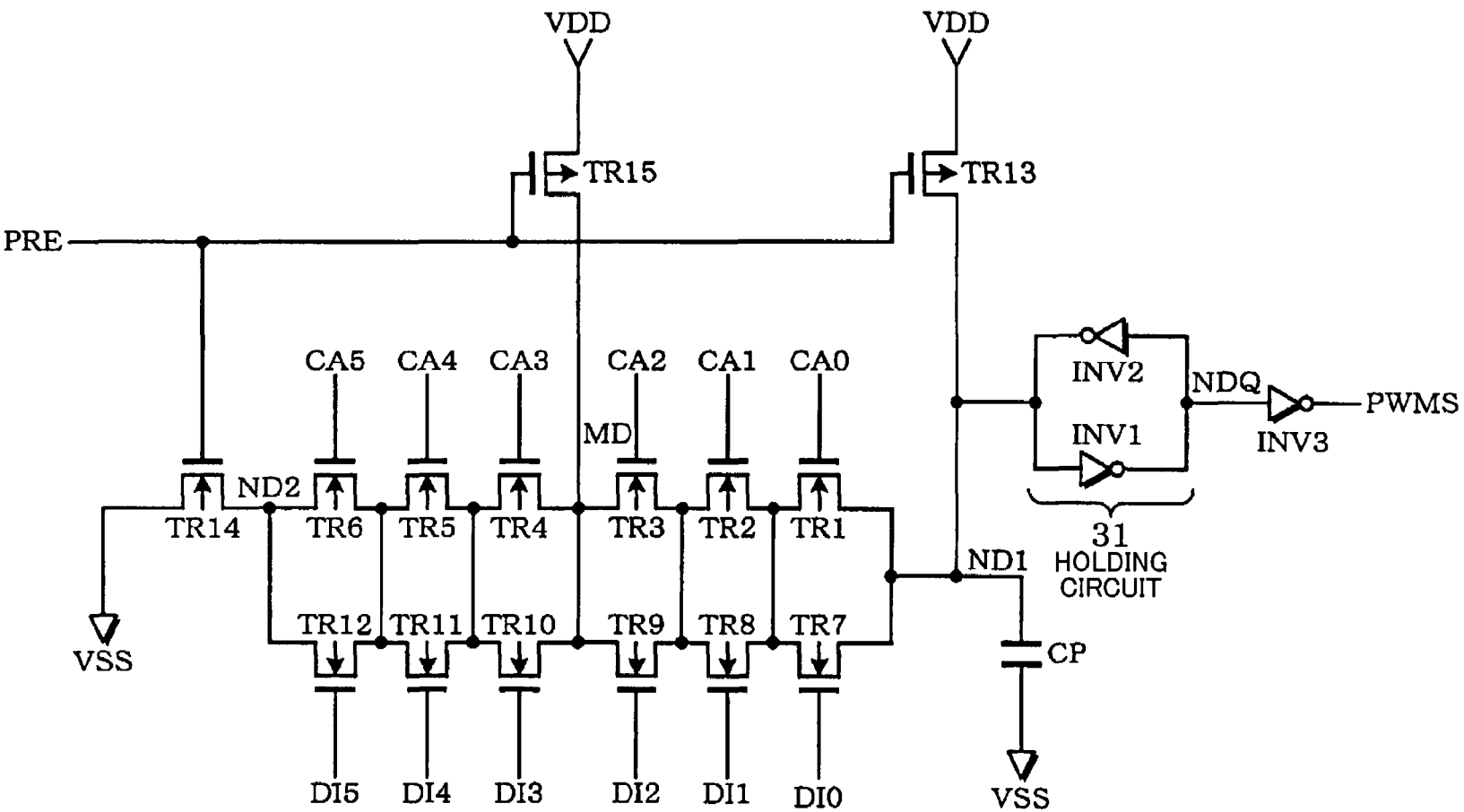
FIG. 11 is a circuit diagram of a grayscale coincidence detection circuit according to this embodiment.

FIG. 11 is a circuit diagram of the grayscale coincidence detection circuit 30 according to this embodiment. In this embodiment, the grayscale coincidence detection circuit 30 is configured so that n=6 and K=3 as an example.

A precharge signal PRE temporarily falls to the low level from the high level and then rises to the high level in units of one horizontal scan period, for example. This causes transistors TR13 and TR15 to be turned ON, whereby a node ND1 and an intermediate node MD are precharged. When the node ND1 has been precharged, a holding circuit 31 holds a voltage at the high level and causes a PWM signal PWMS to be set at the high level.

Signals CA0 to CA5 for each bit of a first digital signal are respectively input to gate electrodes of transistors TR1 to TR6. In this embodiment, the grayscale count value GCT, which is sequentially updated, is input from the grayscale counter 700 as the first digital signal. The signals for each bit of the grayscale count value GCT are hereinafter called digital signals CA0 to CA5. Signals DI0 to DI5 for each bit of a second digital signal are respectively input to gate electrodes of transistors TR7 to TR12. In this embodiment, each bit of the grayscale data included in the display data stored in the display data storage circuit 40 is inverted and input as the second digital signal. The inverted signals for each bit of the grayscale data are hereinafter called digital signals DI0 to DI5.

When the grayscale data is "8"=(000100), the digital signals DI0 to DI5 are (111011). Therefore, only the transistor TR10 to which the digital signal DI3 is input at the gate electrode is turned OFF, and the transistors TR7 to TR9, TR11, and TR12 are turned ON. When the digital signals CA0 to CA5 become (000100) in this state, the transistor TR4 is turned ON, whereby a path from the node ND1 to a node ND2 conducts electricity. A transistor TR14 has been turned ON.

This causes the node ND2 to fall to the low level (VSS), whereby the PWM signal PWMS falls to the low level. Therefore, the grayscale coincidence detection circuit 30 can output the PWM signal corresponding to the grayscale data "8" to the data line driver circuit 20.

The grayscale coincidence detection circuit 30 detects coincidence between the grayscale data and the grayscale count value GCT as described above by detecting a state in which the first digital signals CA0 to CA5 and the second digital signals DI0 to DI5 have had a predetermined relationship. The "state in which the signals have had a predetermined relationship" means a state in which each bit of the first digital signal and each bit of the second digital signal are complementary, for example. Specifically, this state means a complementary relationship in which, when one of the values of these bits is "1", the other value is "0", and, when one of the values of these bits is "0", the other value is "1". For example, when the digital signals CA0 to CA5 are (100000), the grayscale coincidence detection circuit 30 detects that the digital signals CA0 to CA5 and the digital signals DI0 to DI5 have a complementary relationship when the signals DI0 to DI5 are (011111). When the digital signals CA0 to CA5 are (110000), the grayscale coincidence detection circuit 30 detects that the digital signals CA0 to CA5 and the digital signals DI0 to DI5 have a complementary relationship when the signals DI0 to DI5 are (001111).

4. Comparison with Comparative Example

Figure 12:
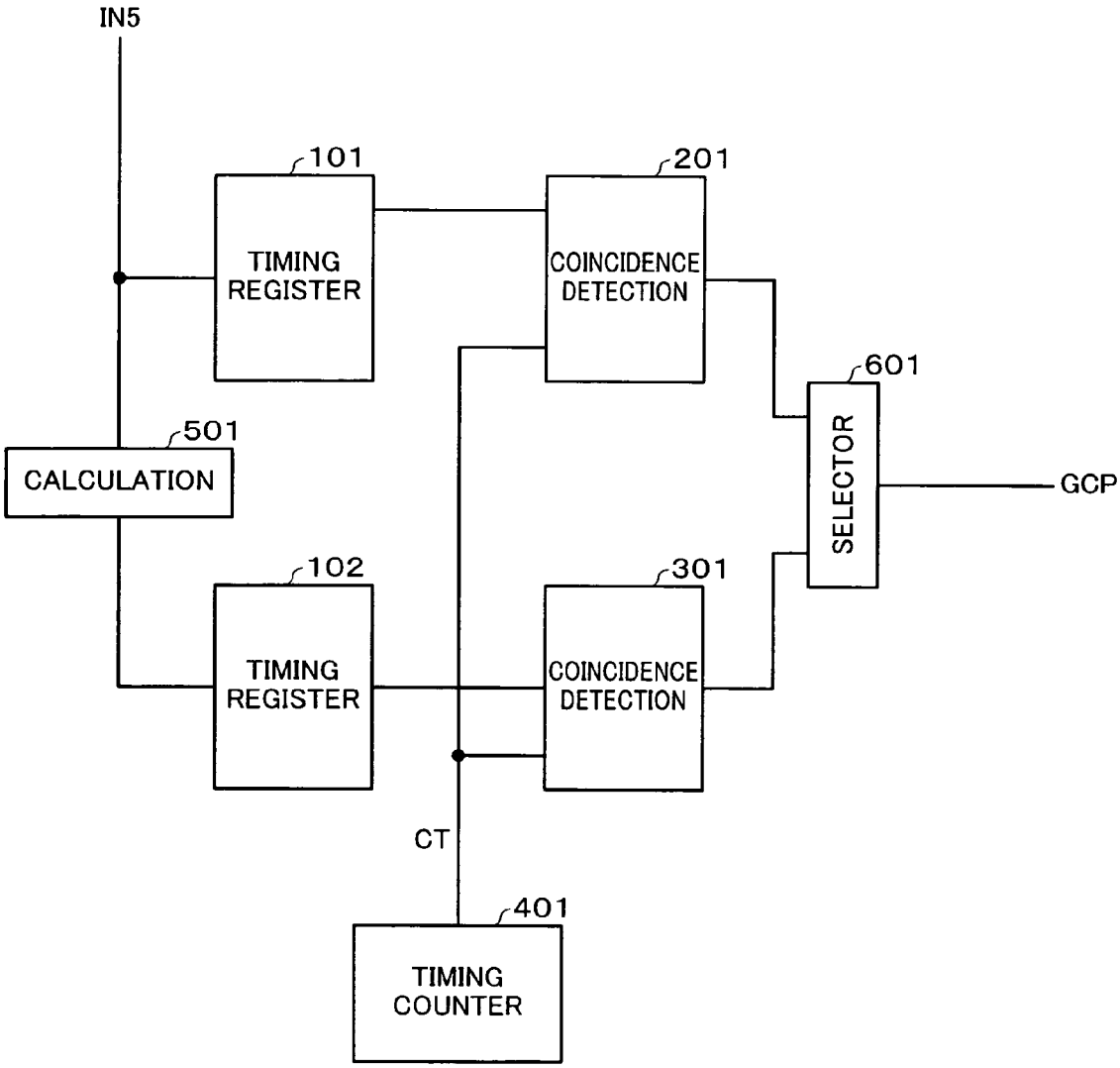
FIG. 12 is a comparative example according to this embodiment.

FIG. 12 is a diagram of a comparative example according to this embodiment. Information which determines the change timing of the voltage level of the PWM signal is written into a timing register 101 through an input IN5. A calculation circuit 501 performs calculation processing of the information which determines the change timing of the voltage level of the PWM signal input to the input IN5, and outputs the resulting information to a timing register 102. The calculation circuit 501 performs calculation processing of the information input to the input IN5 so that the change timing determined by the information input to the timing register 101 and the change timing determined by the information input to the timing register 102 are line-symmetrical with respect to the intermediate position of one horizontal scan period as the center axis.

A timing counter 401 updates the count value CT in the increment direction, for example, and outputs the updated count value CT to coincidence detection circuits 201 and 301. The coincidence detection circuit 201 compares the count value CT with the value stored in the timing register 101, and outputs a grayscale pulse to a selector 601 when the count value CT coincides with the value stored in the timing register 101. The coincidence detection circuit 301 compares the count value CT with the value stored in the timing register 102, and outputs a grayscale pulse to the selector 601 when the count value CT coincides with the value stored in the timing register 102. The selector 601 alternately selects the grayscale pulses output from the coincidence detection circuits 201. and 301 in units of one horizontal scan period, and outputs the grayscale pulse as the grayscale clock pulse GCP.

When expressing 16 grayscales, 16 registers must be provided in each of the timing registers 101 and 102 in the comparative example, for example. Specifically, 32 registers are incorporated in total. In this embodiment, when expressing 16 grayscales, 16 registers, of which the number is half of that in the comparative example, are provided. The circuit area can be reduced by halving the number of registers, whereby a significant effect is obtained for a reduction in power consumption and an increase in image quality.

A PWM signal generation circuit corresponding to 16 grayscales is described in this embodiment as an example. However, this embodiment is not limited thereto. If a PWM signal generation circuit corresponding to 64 grayscales is required, a PWM signal generation circuit may be designed so that N=64, for example.

Since a display driver which can perform a high grayscale representation has been demanded accompanying a recent increase in image quality of a display panel, the number of registers is increased in the PWM method as the number of grayscales is increased. However, in this embodiment, since the number of registers is half of the number of registers in the comparative example, it is easy to install the display driver in a small instrument, and it is possible to deal with a demand for a reduction in power consumption.

As another aspect, it is also possible to configure a PWM signal generation circuit corresponding to both 16 grayscales and 64 grayscales, for example. In this case, the change timing storage circuit 100, the first grayscale clock pulse generation circuit 200, and the second grayscale clock pulse generation circuit 300 for 16 grayscales may be combined with the change timing storage circuit 100, the first grayscale clock pulse generation circuit 200, and the second grayscale clock pulse generation circuit 300 for 64 grayscales. If the range of the count value CT of the timing counter 400 is set at 64 or more, the timing counter 400 can be used for both 16 grayscales and 64 grayscales.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention. Any term cited with a different term having broader or the same meaning at least once in this specification and drawings can be replaced by the different term in any place in this specification and drawings.

What is claimed is:

1. A PWM signal generation circuit comprising:

a change timing storage circuit that stores a pulse change timing of a grayscale clock pulse for generating a PWM signal, a first grayscale clock pulse generation circuit, a second grayscale clock pulse generation circuit, a selector, a timing counter, a calculation circuit, a grayscale counter, and a grayscale coincidence detection circuit, the change timing storage circuit including N (N is an integer greater than one) timing registers, each of the N timing registers storing m bits (m is an integer greater than one) of a predetermined change timing value, the timing counter updating and outputting a first count value in one of an increment direction and a decrement direction in synchronization with a clock signal, the first grayscale clock pulse generation circuit generating a grayscale pulse each time it is judged that the change timing value stored in each of the N timing registers coincides with the first count value, and outputting the grayscale pulse, which is sequentially generated, to the selector as a first grayscale clock pulse, the calculation circuit performing calculation processing of the first count value, and outputting a second count value that is updated in another direction differing from the one direction, the second grayscale clock pulse generation circuit generating a grayscale pulse each time it is judged that the change timing value stored in each of the N timing registers coincides with the second count value, and outputting the grayscale pulse, which is sequentially generated, to the selector as a second grayscale clock pulse, the selector alternately outputting the first or second grayscale clock pulse output from the first or second grayscale clock pulse generation circuit to the grayscale counter as the grayscale clock pulse in units of one horizontal scan period, the grayscale counter updating a grayscale count value in one of the increment direction and the decrement direction based on the grayscale clock pulse output from the selector, and the grayscale coincidence detection circuit comparing a relationship between grayscale data input to the grayscale coincidence detection circuit and the grayscale count value, and changing a voltage level of the PWM signal when the relationship between the grayscale data and the grayscale count value satisfies a predetermined relationship.

2. The PWM signal generation circuit as defined in claim 1, the change timing storage circuit including a first subtractor circuit, and the first subtractor circuit subtracting first adjustment data from the change timing value, and outputting a result of the subtraction to the timing register.

3. The PWM signal generation circuit as defined in claim 2, a value of the first adjustment data being "1".

4. The PWM signal generation circuit as defined in claim 1, the calculation circuit being connected with a resolution storage circuit that stores a resolution value that determines setting accuracy of the change timing of the grayscale clock pulse.

5. The PWM signal generation circuit as defined in claim 4, the calculation circuit including an adder circuit and a second subtractor circuit, the adder circuit adding second adjustment data to the first count value output from the timing counter, and outputting a result of the addition to the second subtractor circuit, and the second subtractor circuit subtracting an output value from the adder circuit from the resolution value, and outputting a result of the subtraction to the second grayscale clock pulse generation circuit as the second count value.

6. The PWM signal generation circuit as defined in claim 5, a value of the second adjustment data being "1".

7. The PWM signal generation circuit as defined in claim 4, the resolution value being $2^m$.

8. The PWM signal generation circuit as defined in claim 1, the first grayscale clock pulse generation circuit including N first timing coincidence detection circuits, the second grayscale clock pulse generation circuit including N second timing coincidence detection circuits, and the N timing registers of the change timing storage circuit being connected with the N first timing coincidence detection circuits and the N second timing coincidence detection circuits.

9. The PWM signal generation circuit as defined in claim 8, the first grayscale clock pulse generation circuit including a first OR circuit, and the first OR circuit calculating logical OR of an output from at least (N−1) first timing coincidence detection circuit among the N first timing coincidence detection circuits, and outputting a result of the calculation to the selector.

10. The PWM signal generation circuit as defined in claim 9, the selector outputting an output from at least one first timing coincidence detection circuit among the N first timing coincidence detection circuits to a data line driver circuit that is an output destination of the grayscale coincidence detection circuit, without outputting the output from the at least one first timing coincidence detection circuit to the grayscale counter.

11. The PWM signal generation circuit as defined in claim 10, a value "0" being stored in the timing register connected with the at least one first timing coincidence detection circuit.

12. The PWM signal generation circuit as defined in claim 8, the second grayscale clock pulse generation circuit including a second OR circuit, and the second OR circuit calculating logical OR of an output from at least (N −1) second timing coincidence detection circuit among the N second timing coincidence detection circuits, and outputting a result of the calculation to the selector.

13. The PWM signal generation circuit as defined in claim 12, the selector outputting an output from at least one second timing coincidence detection circuit among the N second timing coincidence detection circuits to a data line driver circuit that is an output destination of the grayscale coincidence detection circuit, without outputting the output from the at least one second timing coincidence detection circuit to the grayscale counter.

14. The PWM signal generation circuit as defined in claim 13, the change timing value closest to $2^m$ being stored in the timing register connected with the at least one second timing coincidence detection circuit.

15. A display driver comprising:

the PWM signal generation circuit as defined in claim 12, and a data line driver circuit that drives a plurality of data lines, the data line driver circuit receiving the PWM signal and controlling a grayscale of the data lines based on the PWM signal.

16. The display driver as defined in claim 15, comprising:

a third OR circuit that outputs a latch pulse to the data line driver circuit, the selector alternately selecting the first and second grayscale clock pulse generation circuits in units of one horizontal scan period, when the first grayscale clock pulse generation circuit is selected, the selector outputting an output from at least one of the first timing coincidence detection circuits to the third OR circuit, without outputting the output from the at least one first timing coincidence detection circuit to the grayscale counter, and outputting an output from the other of the first timing coincidence detection circuits to the grayscale counter and the third OR circuit, and when the second grayscale clock pulse generation circuit is selected, the selector outputting an output from at least one of the second timing coincidence detection circuits to the third OR circuit, without outputting the output from the at least one second timing coincidence detection circuit to the grayscale counter, and outputting an output from the other of the second timing coincidence detection circuits to the grayscale counter and the third OR circuit, and the third OR circuit calculating logical OR of a value input by the selector and outputting a result of the calculation to the data line driver circuit as the latch pulse.

17. The PWM signal generation circuit as defined in claim 1, the grayscale coincidence detection circuit receiving the grayscale count value as an n-bit first digital signal, receiving the grayscale data as an n-bit second digital signal, comparing the n-bit first digital signal with the n-bit second digital signal, and detecting a state in which the first digital signal and the second digital signal have had a predetermined relationship, the grayscale coincidence detection circuit including:

serially connected first to n-th transistors of first conductivity type, each bit of the first digital signal being input to a gate electrode of each of the first to n-th transistors;

serially connected (n+1)th to 2n-th transistors of first conductivity type, each bit of the second digital signal being input to a gate electrode of each of the (n+1)th to 2n-th transistors, and a source terminal and a drain terminal of each of the (n+1)th to 2n-th transistors being connected with a source terminal and a drain terminal of each of the first to n-th transistors;

a first precharge circuit that is connected with a first node to which the drain terminal of each of the first and (n+1)th transistors is connected and that precharges the first node to a first power supply potential side when a precharge signal has become active;

a connection circuit that is connected with a second node to which the drain terminal of each of the n-th and 2n-th transistors is connected and that connects the second node with a second power supply potential when the precharge signal has become inactive;

a holding circuit that holds a potential of the first node; and a second precharge circuit that is connected with an intermediate node to which the source terminals of the K-th and (K+n)th (K is a natural number provided that $1<K<n$) transistors are connected and that precharges the intermediate node to the first power supply potential side when the precharge signal has become active, and the second precharge circuit being connected with the intermediate node that allows K to satisfy a relationship $2 \leqq K \leqq n-2$.

18. A display driver comprising:

the PWM signal generation circuit as defined in claim 17, and a data line driver circuit that drives a plurality of data lines, the data line driver circuit receiving the PWM signal and controlling a grayscale of the data lines based on the PWM signal.

19. A display driver comprising:

the PWM signal generation circuit as defined in claim 1, and a data line driver circuit that drives a plurality of data lines, the data line driver circuit receiving the PWM signal and controlling a grayscale of the data lines based on the PWM signal.

20. The display driver as defined in claim 19, comprising:

a display data storage circuit that stores display data for at least one frame, the grayscale coincidence detection circuit comparing a relationship between the grayscale data included in the display data stored in the display data storage circuit and the grayscale count value, and outputting the PWM signal to the data line driver circuit when the relationship between the grayscale data and the grayscale count value satisfies a predetermined relationship.

* * * * *